US005848344A

United States Patent [19]

Milillo et al.

[11] Patent Number: 5,848,344

[45] Date of Patent: Dec. 8, 1998

[54] COPY MEDIA REGISTRATION MODULE

[75] Inventors: William D. Milillo, Ontario; Eugene F. Miller, Fairport, both of N.Y.

[73] Assignee: Xerox Corporation, Stamford, Conn.

[21] Appl. No.: 874,416

[22] Filed: Jun. 13, 1997

[51] Int. Cl.[6] ..... G03G 15/00

[52] U.S. Cl. ..... 399/395; 271/228; 356/429; 399/394

[58] Field of Search ..... 399/388, 389, 399/394, 395, 396, 322; 271/227, 228, 246; 356/429, 430, 446

[56] References Cited

U.S. PATENT DOCUMENTS

| | | | |
|---|---|---|---|
| 4,438,917 | 3/1984 | Janssen et al. | 271/227 |
| 4,511,242 | 4/1985 | Ashbee et al. . | |
| 4,519,700 | 5/1985 | Barker et al. . | |
| 4,971,304 | 11/1990 | Lofthus | 271/227 |
| 5,078,384 | 1/1992 | Moore | 271/228 |
| 5,090,683 | 2/1992 | Kamath et al. | 271/227 |
| 5,094,442 | 3/1992 | Kamprath et al. | 271/227 |
| 5,156,391 | 10/1992 | Roller | 271/227 |
| 5,169,140 | 12/1992 | Wenthe, Jr. | 271/228 |
| 5,219,159 | 6/1993 | Malachowski et al. | 271/228 |
| 5,273,274 | 12/1993 | Thomson et al. | 271/228 |
| 5,278,624 | 1/1994 | Kamprath et al. . | |
| 5,652,943 | 7/1997 | Matsuo | 399/389 X |

FOREIGN PATENT DOCUMENTS

| | | |
|---|---|---|
| 58-072960 | 5/1983 | Japan . |
| 2-211458 | 8/1990 | Japan . |
| 6-056313 | 3/1994 | Japan . |

*Primary Examiner*—Matthew S. Smith
*Attorney, Agent, or Firm*—Michelle Waites

[57] ABSTRACT

A copy media registration module for positioning paper in a feed path is disclosed. More specifically, the present invention is directed to a module for registering copy media on an imaging member that lies at the end of a paper path, where the registration module can be removed from and replaced into a machine as a single unit. In addition, enhancements can be added to the module to provide for even more accurate copy media registration and greater media substrate latitude as desired. The modular nature of the registration module allows diagnostic testing as well as repairs and/or periodic maintenance to be easily conducted on the unit outside of the machine in which it is typically used. It also provides easy replacement of the unit if it is no longer functional, or for a temporary unit to be used while the permanent unit is being repaired.

29 Claims, 7 Drawing Sheets

COPY MEDIA REGISTRATION MODULE

The present invention is directed to a method and apparatus for positioning paper in a feed path.

More specifically, the present invention is directed to copy media registration module which can be removed from and replaced into a printing machine as a single unit. Numerous advantageous features can be added to the module to significantly enhance the quality of the printed output.

BACKGROUND OF THE INVENTION

The xerographic imaging process begins by charging a photoconductive member to a uniform potential, and then exposing a light image of an original document onto the surface of the photoconductor, either directly or via a digital image driven laser. Exposing the charged photoconductor to light selectively discharges areas of the surface while allowing other areas to remain unchanged, thereby producing an electrostatic latent image of the document on the surface of the photoconductive member. A developer material is then brought into contact with the surface of the photoconductor to transform the latent image into a visible reproduction. The developer material includes toner particles with an electrical polarity opposite that of the photoconductive member, causing them to be naturally drawn to it. A blank copy sheet or other type of copying media is brought into contact with the photoreceptor and the toner particles are transferred thereto by electrostatic charging the media. The copy media is subsequently heated, for permanent affixing of the reproduced image thereto to produce a "hard copy" reproduction of the document or image. The photoconductive member is then cleaned to remove any charge and/or residual developing material from its surface to prepare it for subsequent imaging cycles.

Blank copy media of a variety of sizes are typically stored in trays that are mounted at the side of the machine. In order to duplicate a document, copy media having the appropriate dimensions is transported from the tray into the paper path just ahead of the photoreceptor. The copy media is then brought in contact with the toner image that is present on the surface of the photoreceptor prior to transfer. If the copy media has not been oriented or registered properly before it is brought in contact with the toner image, the toner image may be fused at an improper location on the copy media, causing it to be skewed or too far up, down, front or back on the page.

Conventional media aligning methods and apparatus' require independent placement of the many elements of the registration system within the printing machine. These elements include, but are not limited to rollers, motors and their associated hardware, which are typically placed at various locations along or near the paper path. While independent placement of different portions of the registration system has been successful in operating the machine, their independent placement often makes it difficult to access them when it is necessary to do so. For example, replacing one of the motors used to control the drive rollers often requires disassembling an extensive portion of the machine. For that matter, when the registration system is not operating properly, the entire machine must often be disassembled in order to conduct diagnostic testing before the non-working system component can be identified. Thus, it is advantageous to develop and combine all of the required parts of a registration system and their associated hardware into a single registration module that can be removed from and replaced into a printing machine as a single unit. This will allow for easy accessibility of the parts, and therefore, simplification of their repair. The availability of a single, compact module also enables diagnostic testing to be performed on the unit as a whole, rather than requiring testing of each individual part.

The following disclosures may also be relevant to various aspects of the present invention:

U.S. Pat. No. 5,278,624 to Kamprath et al. issued Jan. 11, 1994 discloses a differential drive registration system for copy sheets which uses a pair of drive rolls and a drive system for commonly driving both drive rolls. A differential drive mechanism changes the relative angular position of one of the rolls with respect to the other roll to deskew the copy sheet. A control system is supplied with inputs representative of the copy sheet and controls the differential drive mechanism to deskew the copy sheet.

U.S. Pat. No. 5,273,274 to Thomson et al. issued Dec. 28, 1993 describes a sheet feeding and lateral registration system including feed rollers for feeding sheets in a process direction and registration apparatus for registering each sheet in a direction laterally of the process direction. The registration apparatus includes a shifting system for laterally shifting a carriage on which the feed rollers are mounted. A single edge sensor is arranged to provide a signal on detecting the presence of a sheet, and a control controls the lateral shifting system in response to that signal. The control is operated such that if the sheet is not detected by the sensor on initial entry of the sheet into the feed rollers, then the shifting system is activated to move the feed rollers laterally towards the sensor until the sheet is detected by the sensor, whereupon the lateral movement is stopped. If the sheet is detected by the sensor on initial entry of the sheet into the system, then the shifting system is activated to move the feed rollers laterally away from the sensor until the sensor no longer detects the sheet, and then the shifting system is reverse activated to laterally move the feed rollers back towards the sensor until the sheet is again detected by the sensor.

U.S. Pat. No. 5,219,159 to Malachowski et al. issued Jun. 15, 1993 discloses an apparatus to bilaterally register and deskew sheets in an electrophotographic printing machine by driving the sheet against a pair of stalled drive rolls and then activating the drive rolls when the sheet is deskewed. A stepper motor is used to translate the roll pairs in a lateral direction and the pulse counts are utilized to store the side registration and sheet acquisition positions thereby eliminating the need for a home position sensor or switch.

U.S. Pat. No. 5,169,140 to Wenthe, Jr. issued Dec. 8, 1992 discloses a method and apparatus for deskewing and side registering a sheet. A sheet is first driven non-differentially in a process direction with a sheet driver, and the angle of skew is measured with an initial skew sensing mechanism. The sheet is then driven differentially with a sheet driver to compensate for the magnitude of side-to-side misregistration, thereby inducing a registration angle of skew. The method also includes determining an absolute angle of skew, and driving the sheet differentially with the sheet driver to compensate for he absolute angle of skew so that the sheet is deskewed and one edge of the sheet is side registered. An apparatus for carrying out the method is also disclosed.

U.S. Pat. No. 5,156,391 to Roller issued Oct. 20, 1992 discloses a method and apparatus in which copy sheets in a short paper path in an electrophotographic printing machine may be deskewed by differentially driving two sets of rolls so as to create a paper buckle buffer zone in the sheet and then differentially driving a roll set to correct the skew while the sheet is still within the nips of multiple drive roll sets. Leasing edge damage to sheets is eliminated as the deskewing rolls are initially traveling at the same velocity as the sheet.

U.S. Pat. No. 5,094,442 to Kamprath et al. issued Mar. 10, 1992 discloses a translational electronic registration (TELER) system which describes a method and apparatus for registering copy paper or documents. It generally includes three optical sensors, a pair of coaxial independently driven drive rolls, a carriage with a linear drive on which paper drive rolls are mounted, and a microprocessor controller. A blank copy media is driven into the nip rolls and moved through the paper path for placement and fusing of an image thereon. The speed of both nip rolls can be controlled to effect skew alignment and longitudinal registration. The nip rollers are mounted on a carriage movable transversely with respect to the feed path. A sensor system controls positioning of the carriage to achieve the desired top edge or a lateral positioning of the copy media. Independent control of nip roll drive and carriage translation provides simultaneous alignment in lateral and longitudinal directions.

U.S. Pat. No. 5,090,683 to Kamath et al. issued Feb. 25, 1992 describes a device for selectively turning documents. First and second drive rollers are aligned along an axis transverse to a process direction in which documents are fed. First and second follower rollers are aligned with the first and second drive rollers. One drive roller is operated at a substantially constant peripheral velocity by constant velocity drive motor while the other drive roller is operated at a variable peripheral velocity by a variable speed drive so that the document is turned. The variable speed drive is driven through a variable velocity profile to control the amount of rotation of the document. A pair of sensors is placed adjacent to the drive rollers so the skew of the document can be measured prior to being rotated and can be used to determine the velocity profile for controlling the variable speed motor. After the document is rotated, the same two sensors are used to detect the skew, if any, of the trailing edge of the turned document for correction of the velocity profile used to rotate subsequent documents. An additional mechanism can be provided for shifting the connection of the constant velocity and variable speed motors between the first and second drive rollers so that a sheet can be rotated in opposite directions.

U.S. Pat. No. 5,078,384 to Moore issued Jan. 7, 1992 discloses a method and apparatus for deskewing and registering a copy sheet, including the use of two or more selectably controllable drive rolls operating in conjunction with sheet skew and lead edge sensors, for frictionally driving and deskewing sheets having variable lengths. The sheets are then advanced to reach a pre-defined registration position at a predetermined velocity and time, at which point said sheets will no longer be frictionally engaged by said drive rolls.

U.S. Pat. No. 4,971,304 to Lofthus issued Nov. 20, 1990 describes a method and apparatus for an improved active sheet registration system which provides deskewing and registration of sheets along a paper path in X, Y and theta directions. Sheet drivers are independently controllable to selectively provide differential and non differential driving of the sheet in accordance with the position of the sheet as sensed by an array of at least three sensors. The sheet is driven non differentially until the initial random skew of the sheet is measured. The sheet is then driven differentially to correct the measured skew, and to induce a known skew. The sheet is then driven non differentially until a side edge is detected, whereupon the sheet is driven differentially to compensate for the known skew. Upon final deskewing, the sheet is driven non differentially outwardly from the deskewing and registration arrangement.

U.S. Pat. No. 4,519,700 to Barker et al. issued May 28, 1985 describes a xerographic image transfer device in which copy sheets are sequentially aligned and position sensed before introduction to the image transfer zone. The position sensing is used to compare the copy sheet location with the position of the image panel on a moving photoconductor. The timing and velocity profile of the copy sheet drive after the position sensing is arranged so that the copy sheet arrives in registry with the image panel and at the same velocity.

U.S. Pat. No. 4,511,242 to Ashbee et al. issued Apr. 16, 1985 discloses a device utilizing electronic alignment of paper feeding components in a machine such as an electrophotographic copier. Alignment is obtained by placing an original master containing vernier calibrations on the document class and a target master containing vernier calibrations in the copy paper bin. The machine is operated to produce a copy of the original master onto the target master producing a double set of vernier calibrations on the target master, which, when compared, provide information relating to skew angle, side edge relationship and leading edge alignment of the image to the copy paper. The vernier calibrations provide data which are read into a microprocessor controlled copy feeding servo mechanism to correct copy paper position and remove misalignment. This operation is repeated for various combinations of paper feed paths so that the copy paper matches image position for all modes of copier operation. Additionally, sensors are located in the paper path to automatically correct for deviations in the copy sheet feeding unit, caused by wear, for example, over a period of time.

U.S. Pat. No. 4,438,917 to Janssen et al. issued Mar. 27, 1984 discloses a device for feeding sheets from a supply station aligning the sheets in an X, Y and theta coordinates and then gating the sheet into a work station. The device includes a pair of independently servo controlled motors disposed on opposite sides of the sheet. Each motor drives a nip roller which transports the copy sheet. Sensors are disposed to generate signals representative of sheet position in the X, Y and theta coordinates, which signals are used by the controller to adjust the angular velocity of the motor so that the sheet is squared and is gated onto the work station.

U.S. Pat. No. 5,678,159 to Williams et al. issued Oct. 14, 1997 entitled "Sheet Registration and Deskewing Device" discloses a deskewing and registering device for an electrophotographic printing machine. A single set of sensors determine the position and skew of a sheet in a paper path and generate signals indicative thereof. A pair of independently driven nips forward the sheet to a registration position in skew and at the proper time based on signals from a controller which interprets the position signals and generates the motor control signals. An additional set of sensors can be used at the registration position to provide feedback for updating the control signals as rolls wear or different substrates having different coefficients of friction are used.

U.S. Pat. No. 5,697,609 to Williams et al. issued Dec. 16, 1997 entitled "Lateral Sheet Pre-Registration Device" discloses a registering device for an electrophotographic printing machine. A steerable pair of drive nips is located in the paper path. A lead edge sensor detects when a sheet is within the steerable drive nips. The steerable nips are turned so that the sheet is transported toward a side registration sensor located in the paper path. When the side registration sensor detects the edge of the sheet the actuator causes the steerable nips to be straightened. The sheet may be forwarded to a second, higher accuracy registration device for final registration. The steerable nip device provides a course pre-registration device which may utilize inexpensive and non complex components. This device also enables the use of less expensive components in the fine registration device as the range of correction required by the fine registration device can be much narrower due to the pre-registration device.

U.S. Pat. No. 5,794,196 to Milillo issued Aug. 11, 1998 entitled "Adaptive Electronic Registration System" discloses a method and apparatus for positioning paper in a feed path by providing continuous feedback of copy media registration parameters is disclosed. The invention includes a system which compares measured copy media registration information with an ideal value stored in a microprocessor. These measured registration parameters are averaged and pertinent information is fed back to the control system of the copy media registration device. The information that has been fed back is then used to adjust the orientation of subsequent copy media, thereby allowing for ideal placement of the copy media onto the photoreceptor for successful transfer of a developed image.

Copending application U.S. Ser. No. 08/728,028 to Borton et al. filed Oct. 7, 1996, entitled "Adaptive Sensor and Interface" discloses a multifunctional sensor that can detect the presence of substrates, including various opaque/translucent substrates as well as transparent substrates moving through a paper path. The sensor includes an LED disposed near the transporting path for projecting light toward a reflector on the opposite side of the media transport path and a phototransistor located relative to the LED and reflector to receive light reflected from the reflector which is periodically interrupted by substrates within the transporting path to provide an output proportional to the light received from the LED via the reflector. The operating range of the phototransistor has a linear portion and a saturated portion. A control, electrically connected to the sensor, adjusts the phototransistor to maintain the output signal in the linear portion of the operating range. The sensor is tilted at an angle with respect to the horizontal of a copy substrate to be able to detect transparencies.

Copending application U.S. Ser. No. (not yet assigned, our ref. D/97253Q) to Milillo, concurrently filed, entitled "Method and Apparatus for Detecting Holes in Copy Media" discloses a copy media registration module for positioning paper in a feed path. More specifically, the invention is directed to a method and apparatus for detecting pre-drilled holes in copy media. A sensor detects the presence and absence of copy media in the feed path. Once a transition from paper to no-paper, or from no-paper to paper occurs, subsequent signals from the sensor are ignored for a designated period of time. At the leading edge of the sheet, this designated time period is chosen such that any possible holes will have moved past the sensor. At the trailing edge of the sheet, the designated time period is chosen based upon the maximum possible size of any holes that may be present.

All of the references cited herein are incorporated by reference for their teachings.

Accordingly, although known apparatus and processes are suitable for their intended purposes, a need remains for an apparatus capable of properly registering copy media a the end of a paper path, in which multiple aspects and enhancements can be combined in a single unit. This enables easy removal of the device from a printing machine for diagnostic testing as well as replacement.

SUMMARY OF THE INVENTION

In accordance with the present invention, there is provided a copy media registration module for continuously positioning copy media, which includes a drive roll system; a generator which imposes motion upon the drive roll system; a connector for attaching the generator to an external power supply; and a housing surrounding the drive roll system and the generator such that the housing, the drive roll system and the generator are mountable to and removable from an external device as a single unit.

In accordance with another aspect of the invention, there is provided a copy media registration module which includes a drive roll system that has a plurality of counter rotating rolls defining a nip, for receiving the copy media from a feed path and advancing it to a target; a detection system which detects misalignment of the copy media as it enters the nip; and an alignment correction device which properly aligns the copy media and advances it to the target.

In accordance with still another aspect of the invention, there is provided an electrophotographic printing machine, including an electrophotographic imaging member upon which an electrostatic latent image is generated, and onto which a developer material is deposited to transform the latent image into a developed image; a copy media registration module removable from and replaceable to a location between an end of the feed path and the electrophotographic imaging member, the copy media registration module advancing the copy media to the electrophotographic imaging member, and detecting and eliminating a misalignment of the copy media, as the copy media is advanced to the electrophotographic imaging member; a feed path along which the copy media is transported from the paper tray through the copy media registration module; and a paper tray for storing copy media, and for advancing the copy media to a feed path.

In accordance with yet another aspect of the present invention there is provided an electrophotographic printing machine with a copy media registration module that includes a drive roll system; a generator which imposes motion upon the drive roll system; a connector for attaching the generator to an external power supply; and a housing surrounding the drive roll system and the generator such that the housing, the drive roll system and the generator are mountable to and removable from an external device as a single unit.

In accordance with yet another aspect of the present invention there is provided a copy media registration module having a drive roll system that includes a plurality of counter rotating rolls defining a nip, for receiving the copy media from a feed path and advancing it to a target; a detection system which detects misalignment of the copy media as it enters the nip; and an alignment correction device which properly aligns the copy media and advances it to the target.

The present invention has significant advantages over current methods of aligning copy media in a feed path. First, it combines several independently operatable registration devices into a single unit that can easily be placed into a printing machine. Also, it includes additional enhancements, including, a method of incrementally changing media registration position based upon throughput volume, and a method of providing proper registration sensing of media with pre-drilled holes. The method of changing position based upon throughput allows for even distribution of the media past the fuser roll, thereby controlling wear and increasing the life of the fuser roll, while the pre-drilled hole sensing method allows holes which pre-exist in copy media for the purpose of placing finished sheets in looseleaf binders to be distinguished from the lead and/or trail edges of transported copy media.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

The present invention is directed to a method and apparatus for positioning paper in a feed path. More specifically, the present invention is directed to copy media registration module which can be removed from and replaced into a printing machine as a single unit. The quality of the printed output can also be enhanced by adding features to the invention.

Figure 1:
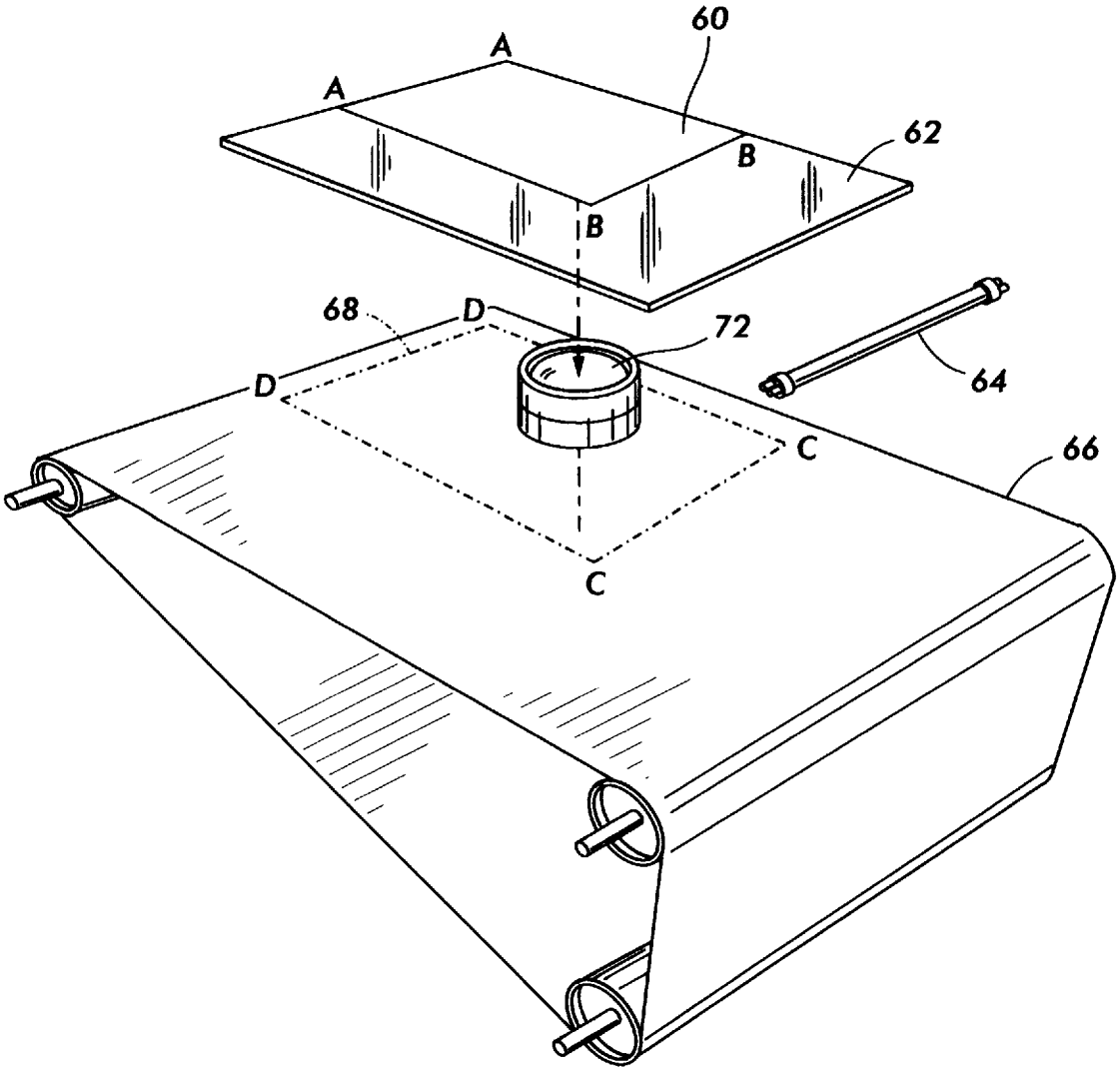
FIG. 1 depicts an isometric view of a possible layout of the interior of a xerographic copy machine. Relative positions of the platen glass, document, light source, lens, and photoreceptor are shown.

Referring now to the drawings where the showings are for the purpose of describing an embodiment of the invention and not for limiting same, FIG. 1 is used to illustrate an example light lens copying operation which begins by placing the document 60 face down upon the platen glass 62, such that the right edge of the original image is lined up with axis A. Axis B corresponds to the location at which the left edge of document 60 comes in contact with platen glass 62. It should be noted that the left edge of the image will rest at locations further away from or closer to axis A to axes B', B", etc. as documents with differing widths are used.

With continued reference to FIG. 1, document 60 is exposed to a light source 64, which causes the image thereon to be reflected back toward the copy machine and onto photoreceptor 66. Passage of the light reflected from document 60 through lens 72 causes latent image 68 projected onto photoreceptor 66 to be reversed such that the left edge of document 60 at axis A will be reflected at axis C on the photoreceptor belt. Thus, the left edge axis A of document 60 will become the trailing edge axis B of latent image 68, and will remain so throughout processing.

Figure 2:
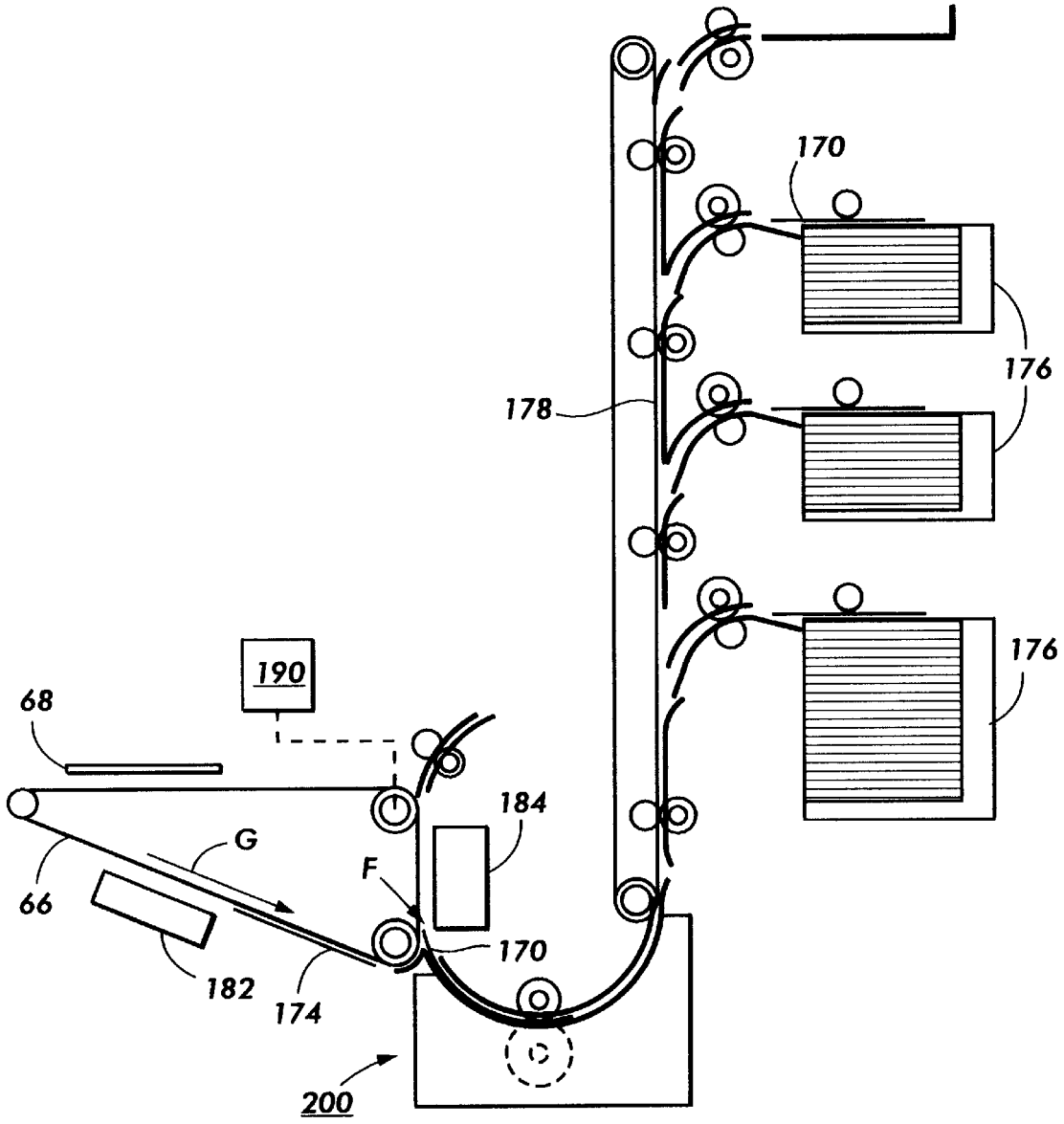
FIG. 2 shows a front view of an interior cavity of a photocopy machine. A photoreceptor is shown with latent and developed images shown thereon. The relative positions of the registration, development, transfer, and fusing stations are also shown. The paper path and media storage trays are also shown.

As shown in FIG. 2, once the latent image is generated, photoreceptor 66 will move latent image 68 in the direction of arrow G. Toner particles are deposited onto it at development station 182, thereby transforming latent image 68 into a developed image 174. Photoreceptor 66 and developed image 174 will then proceed toward transfer station 184.

Before developed image 174 reaches transfer station 184, a blank copy media 170 will be removed from one of paper trays 176 and transported along paper path 178. Copy media 170 will pass through nip 180 between the two rolls at the end of paper path 178 to be placed in contact with developed image 174 just as it reaches transfer station 184. Copy media 170 with developed image 174 thereon will then move through a pre-fuser transport (not shown) to fusing station 188 (not shown) where the toner image will be permanently affixed to copy media 70.

Figure 3:
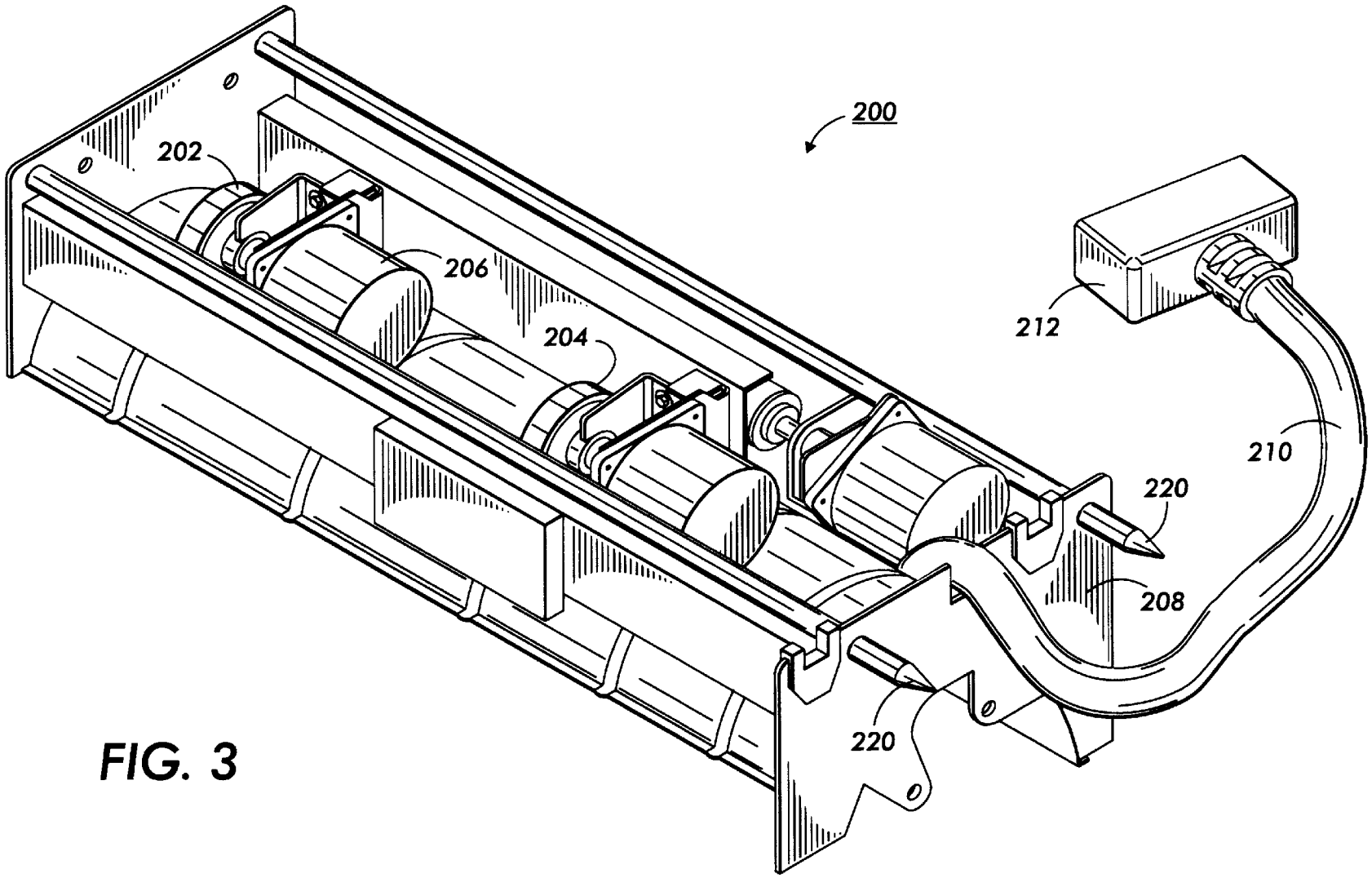
FIG. 3 contains a three dimensional bottom view of a copy registration module of the present invention.
Figure 4:
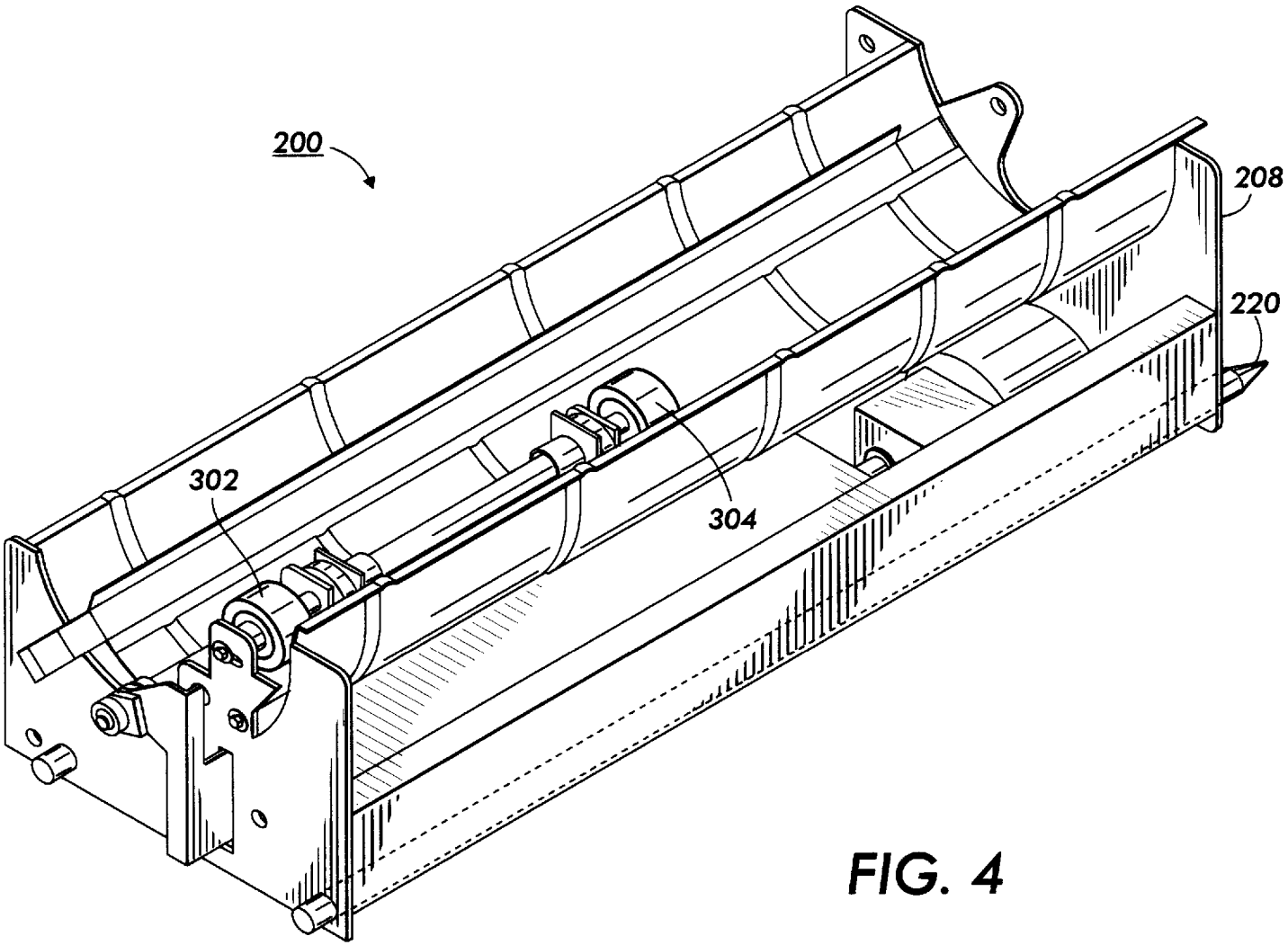
FIG. 4 is a three dimensional view of the top of a copy registration module of the present invention.

Referring now to FIG. 3, registration module 200 of the present invention includes at least two drive roll pairs shown in the illustration as drive roll pair 202/302, and drive roll pair 204/304. (The location of rolls 302 and 304 are best illustrated in FIG. 4). A motor 206 is associated with each drive roll pair. In the preferred embodiment of the invention, motor 206 will be a two phase, brushless, direct current motor. However, the invention is not limited to this embodiment and other types of motors may be used. In addition, motor 206 may rotate each drive roll pair 202/302 or 204/304 at a constant rate, or it may be capable of driving the rate of rotation of the roll pairs at variable rates. If more than one drive roll pair is present, a single motor 206 can be associated with a separate motor 206. In the present invention, drive roll pairs 202/302 and 204/304 and motors 206 are contained within a single registration module 200. Registration module 200 is encased in housing 208, which may be made from any durable material including, but not limited to aluminum, steel, or plastic. The wiring associated with motors 204, and any other components which require the use of an electrical power supply is formed into a single bundle 210 and joined to a single connector 212. Connector 212 is designed such that it plugs into a corresponding connector which is attached to a bundle of wires leading from the printing machine. During printing operation, electrical power is supplied to registration module 200 by attaching connector 212 to a connector mounted to the printing machine. Electrical power is supplied to the printing machine by plugging the machine into a conventional ac outlet. Diagnostic routines and/or repairs and maintenance may be performed outside of the machine by removing the modular registration unit 200 while maintaining its electrical power source and software control via its electrical harnessing interface hardware bundle 210 and connector 212 and the associated printer connection.

A primary feature of registration module 200 is its ability to be removed from and replaced to the printing machine as a single unit. Guides 220 are present to insure that registration module 200 is properly inserted into corresponding mounting holes that are present in the printing machine. Registration module 200 is operable as long as the above mentioned elements—at least two drive roll pairs 202/302 and 204/304 and their associated motors 206—are located inside housing 208, and connector 212 is associated with the unit and able to attach the entire unit to an external electrical supply. However, it will often be desirable to include additional features in the registration system in order to enhance operation of the printing machine. With the present invention, these added enhancements can also be incorporated into the single unit of registration module 200.

For example, an Adaptive Electronic Registration System (AERS) such as that disclosed in U.S. Pat. No. 5,794,176. AERS provides a means for ensuring that copy media 170 is in proper alignment at the time it reaches transfer station 184. The system may successfully be used with any electronic drive roll system. For example U.S. Pat. No. 5,278,624 to Kamprath et al. issued Jan. 11, 1994, or U.S. Pat. No. 5,090,683 to Kamath issued Feb. 25, 1992, both described above.

Briefly, AERS provides continuous feedback about the errors measured during operation of the electronic drive roll system and the adjustments that are being made to correct them. Initial machine clock settings are pre-stored in microprocessor memory locations. Referring again to FIG. 2, these pre-stored settings correspond to an estimate of the amount of time that it will take for the trailing edge of latent image 68 to reach point F, where the trail edge of copy media 170 should contact photoreceptor 66 after flash has occurred. During set up of the printing machine, the estimated values are replaced by actual values when a set up technician runs test copies, and manually adjusts the stored values if imperfect copies are produced. Once the machine has been set up, the actual measurement of the correction required to properly register transported sheets will continuously be compared to the set up values. A running average of the difference between the actual measurements and set up values are maintained in system memory, and appropriate changes are made to the algorithm(s) which control the associated motor(s) in order to continuously optimize registration performance.

Figure 5:
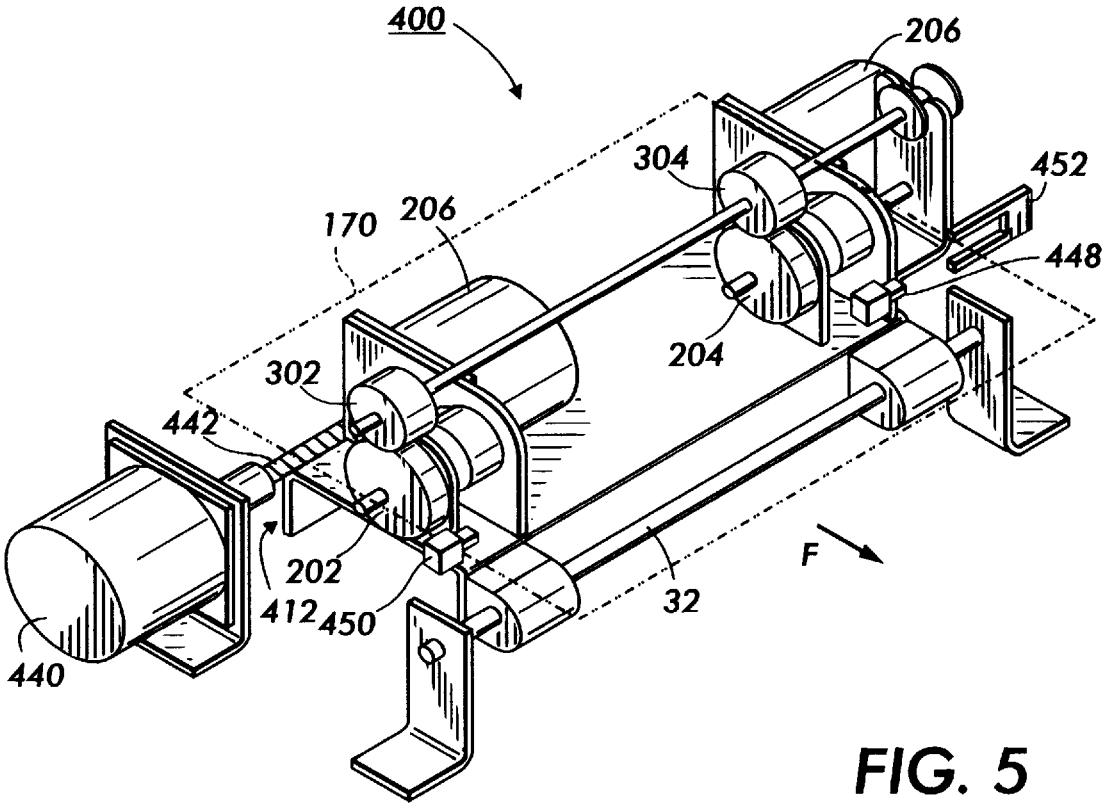
FIG. 5 is an isometric view of a TELER system, one type of electronic drive roll system that may be used with the present invention.

One type of electronic drive roll system known to be significantly enhanced with the addition of an AERS is a translating electronic registration (TELER) system 400, illustrated in detail in FIG. 5. In the embodiment shown, TELER system 400 includes a carriage 412 having two drive rolls 202 and 204 which are mounted thereon in rotatable fashion, and are driven by drive motors 206. The roll pairs 202/302 and 204/304 engage copy media 170 and drive it through TELER system 400. The system includes optical sensors 448, 450 and 452 which will detect the presence of the edges of copy media 170. Two sensors 448 and 450 are mounted on the carriage 412 adjacent the drive rolls 202 and 204 for lead edge detection of the copy media and control of motors 206. The sequence of engagement of the sensors 448 and 450 and the amount of time between each detection is utilized to generate control signals for correcting skew (rotational mis-positioning of the copy media about an axis perpendicular to the copy media) of the copy media by variation in the speed of drive rolls 202 and 204. Sensor 452 is arranged to detect the top edge of the copy media and the output therefrom is used to control transverse drive motor 440.

Figure 6:
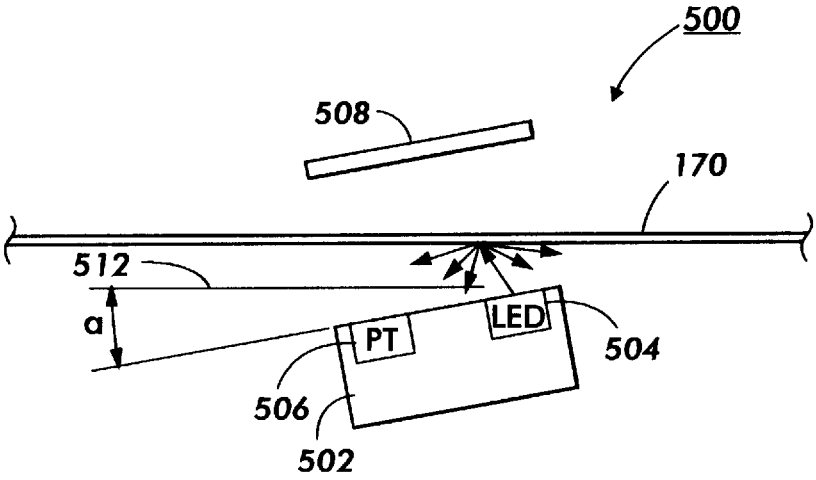
FIG. 6 contains an illustration of an Adaptive Sensor and Interface that may be included with the present invention.

The present invention may also include an Adaptive Sensor and Interface (ASI) 500 such a the one disclosed in copending application Ser. No. 08/828,028. With reference now to FIG. 6, ASI 500 including a sensor 502 which may be any suitable light source such as light emitting diode (LED) 504 and photodetector such as phototransistor 506, functions to discriminate between an opaque/translucent and a transparent or glossy surface substrate. The presence or absence of copy media is determined by measuring the amount of light from light source 504 that reaches photodetector 506 after being reflected from reflector 508. As shown, sensor 502 is tilted at an angle with respect to the horizontal. The positioning of sensor 502, and its operating characteristics allow both transparent and opaque copy media to be detected by ASI 500.

Figure 7:
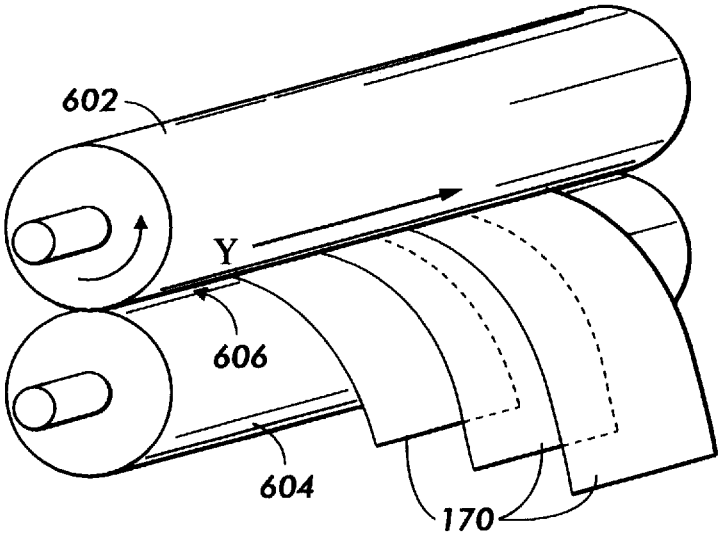
FIG. 7 contains a three dimensional view of a typical xerographic fusing station.

Numerous other enhancements may be included with the present invention to improve overall operation of the printing system. For example, a fusing system is typically included with a xerographic system to provide permanent affixing of the developed image to copy media. Fusing is typically performed by heating the toner particles, causing them to melt and become absorbed into the fibers of the paper or other material from which copy media 170 is made. The toner particles are then cooled, which allows them to solidify and be firmly bonded to copy media 170. With reference now to FIG. 7, one common method of fusing the toner particles requires passing copy media 170 with developed image 174 thereon through a nip 606 between a pair of opposed rollers 602 and 604, at least one of which is either internally or externally heated. In an arrangement such as this, the toner image contacts the surface of the heated roller member in the nip between rollers 602 and 604, thereby producing heating of the toner image within nip 606.

Passing copy media through the same section of nip 606 throughout the printing operation can cause significant wear of rolls 602 and 604 in the area which contacts copy media 170. For this reason, a fuser wear algorithm 610 may be incorporated into registration module 200 to incrementally change the transverse direction edge registration position depending upon the volume of copy media passing through nip 606. In other words, fuser wear algorithm can be used to shift the location of placement of copy media 170 in direction y along rolls 602 and 604. This distributes the wear of fuser rolls 602 and 604 along a larger portion of their surfaces, thereby extending the life of these rolls.

Similarly, with reference now to FIG. 2, under some circumstances it may be advantageous to fill paper trays 176 with copy media 170 that has pre-drilled holes. Another enhancement that may be included with the present invention includes a pre-drilled media algorithm 710 which can be incorporated into registration module 200 in order to ensure proper registration of copy media 170 that has pre-drilled holes 702, best illustrated in FIG. 8.

Figure 8:
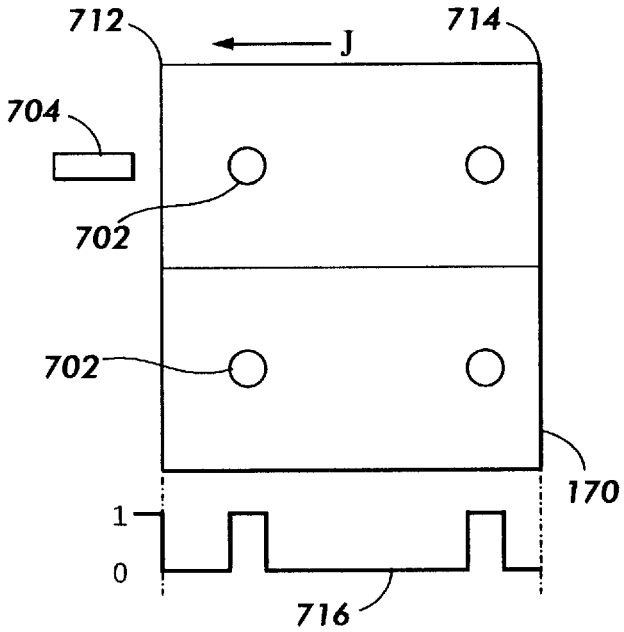
FIG. 8 depicts an example sheet of pre-drilled copy media that may be transported through the present invention.

As stated above, sensors can be used to detect the presence of copy media 170 in paper path 178 by measuring the amount of light that reaches a photodetector. These devices can also be used to detect the presence or absence of holes or slots in copy media 170. Referring now to FIG. 8, sensor 704 should be placed in paper path 178 such that copy media 170 moving through the paper path in the direction of arrow J can be detected. As copy media moves past sensor 704, electronic signals 716 are generated in response to the amount of light measured at the photodetector. A "no paper" signal (which may be either an ON/HI/ 1 signal or an OFF/LOW/0 signal depending upon the chosen configuration) is generated when light is being measured at the photodetector, indicating that a hole has been detected, while a "paper" signal (a signal other than the one chosen for the "no paper" signal) is generated while the solid portion of copy media 170 is being transported past sensor 704. However, a "no paper" signal will also be generated when there is no copy media moving past sensor 704, while an OFF signal will be generated when copy media is moving past sensor 704. Thus, capability which enables sensor 704 to discriminate between the leading edge 712 of a sheet and the back edge of a hole 702 upon receiving a transition from a no paper signal to a paper signal must be added. Similarly, sensor 704 must be able to distinguish the trailing edge 714 of copy media 170 from the front of a hole 702 when a transition from a paper signal to a no paper signal occurs.

Figure 9:
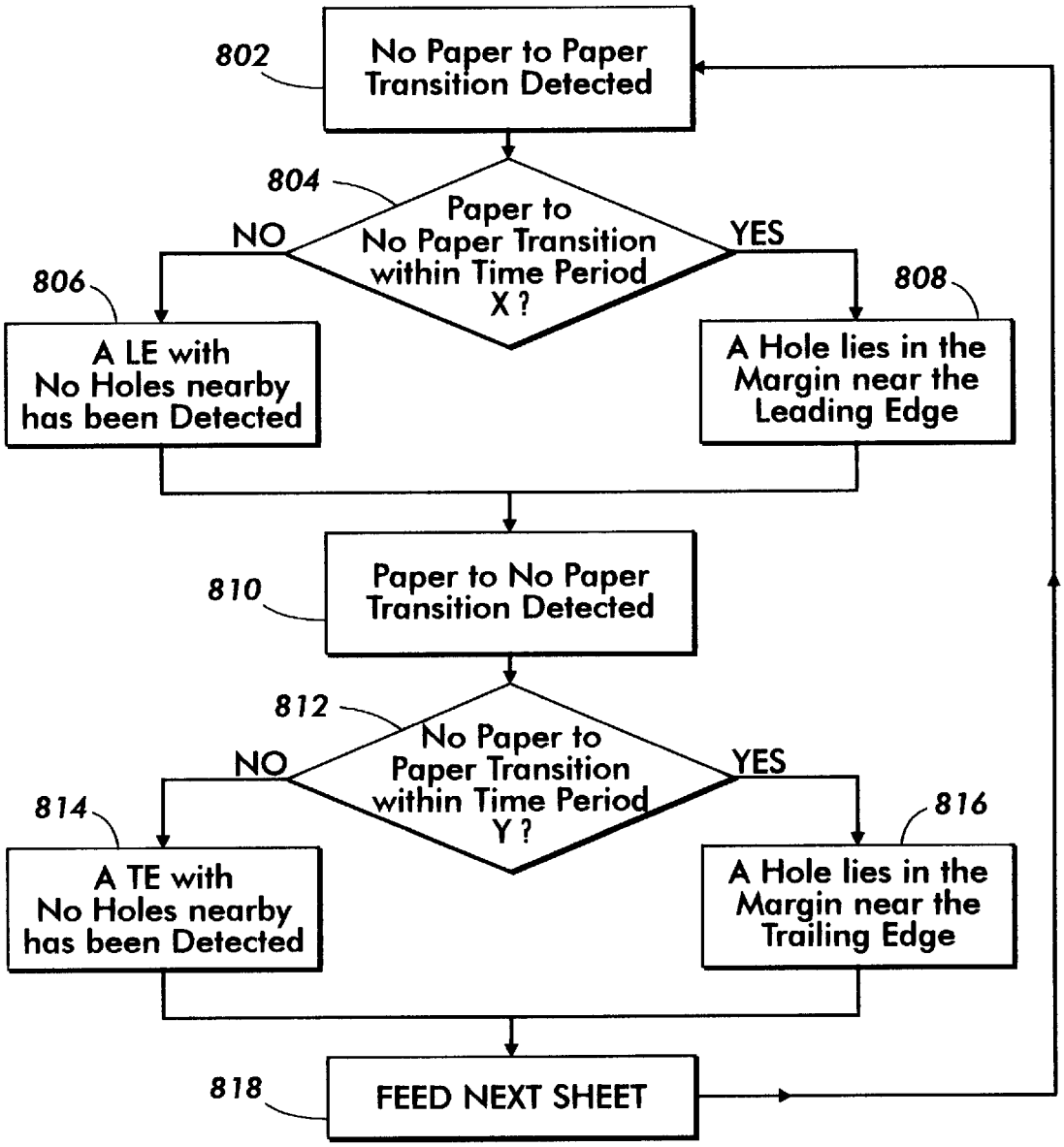
FIG. 9 contains a flow chart describing operation of a pre-drilled media algorithm that may be incorporated into the copy registration module of the present invention.

Referring now to FIG. 9, software can be incorporated into copy registration module 200 of the present invention in order to add this feature. As shown in the diagram, sensor 704 detects a transition from no paper to paper at block 802, indicating a leading edge (LE) of a sheet of new copy media 170. After the no paper to paper signal is received, signals are ignored for a designated period of time. The length of this designated time period must be chosen by considering the speed of the copy machine, and the possible locations of any holes that might be present in copy media.

Quite often, holes in copy media lie within ¾ in. from the leading edge. However, it is not unusual for holes to lie further from the leading edge, or for consecutive holes to be placed next to each other, such that there is at least one hole further than ¾ inch from the leading edge. On the other hand, it is rare that a hole will lie in or near the middle of a page. Thus, the designated time period must simply be long enough to allow the leading edge of the copy media to pass a comfortable distance away from sensor 704, so that it will be clear that the sensor is reading light reflected from the center of the copy media. More specifically, the length of time that should elapse once a no paper to paper signal transition occurs should be determined by dividing the distance the copy media must travel to ensure no holes will be present, by the velocity of the sheet as it passes over the sensing device. In one embodiment of the invention, the speed of copy media 170 as it enters nip 180 is known to be 1000 mm/s, while it is known that no holes will lie more than 100 mm from the leading edge of copy media 170. In this embodiment, the designated time period is approximately 100 ms.

Referring again to the diagram in FIG. 9, if a paper to no paper signal transition has not occurred within the designated time period, a LE with no holes has been detected by sensor 704 as shown in block 806. On the other hand, a transition from a paper signal to a no paper signal within the designated time period X indicates that a hole lies within the allocated distance from the LE of copy media 170, as indicated in block 808. An electronic registration system cannot function properly without a mechanism which accurately detects the leading and trailing edges of copy media. Information about the location of pre-existing holes can also be used by the imaging system of the printing machine to shift the location of the image so information will not be printed over a hole in the copy media.

Similarly, the presence of holes at the trailing edge (TE) of a copy sheet must also be detected, however the process for detecting holes at this end of the page must be slightly different. First, this consideration is being made while a paper signal is already being transmitted from sensor 704. Once a paper to no paper transition occurs as indicated in block 810, the sensor must determine whether or not subsequent no paper to paper transition occurs within a designated time period y as indicated in block 812. Again, this time period must be altered as print speed and hold diameter are changed. However, the length of the time period is chosen by considering the speed of the copy machine, and the largest possible diameter size for any holes that might be present in copy media. This is because it is impossible to simply select an appropriate distance for which it is certain that a no paper to paper transition which follows a paper to no paper transition will mean that the trailing edge of copy media 170 is being sensed, rather than the back of a hole on a subsequent copy sheet. Thus, the designated time period is chosen by considering the largest possible diameter of a hole that will lie near the trailing edge of the copy media. Once the speed at which the copy media 170 exits nip 180 is known, the designated time period should be equal to the amount of time that it will take for the diameter distance to move past the sensor at the known copy speed. In the embodiment described above, it is also known that no holes larger than 10 mm will ever be present on a page. It is also known that the speed of exiting speed of copy media 170 is 480 mm/s. Under these circumstances 20 ms is the approximate time period that will elapse. If a no paper to paper transition does not occur within the given time period, the TE of copy media 170 has been detected as indicated in block 814. The presence of a no paper to paper signal transition indicates that a hole lies in the margin next to the trailing edge of the page as shown in block 816.

The system can automatically be reset as another sheet of copy media 170 is fed from paper tray 176. The information regarding the presence or absence of holes in the margins of copy media 170 can be used for many purposes, including transmitting signals to the imaging system in order to prevent the latent image from being generated in locations on photoreceptor 66 that will correspond to areas on copy media 170 that will contain holes. Also the use of sensors to accurately detect copy media edges is critical to the functioning of an electronic registration system.

The above subsystems are merely examples of the types of enhancements that may be added to copy registration module 200 of the present invention. Any or all of them may be added or removed from the module at a single time. It will also be possible to add other enhancements which have not been mentioned here.

It is, therefore, apparent that there has been provided in accordance with the present invention, a copy media registration module that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A copy media registration module for continuously positioning copy media, comprising:

a) a drive roll system;

b) a generator which imposes motion upon said drive roll system;

c) a connector for attaching said generator to an external power supply; and d) a housing encompassing said drive roll system and said generator such that said housing, said drive roll system and said generator are mountable to and removable from an external device as a single unit.

2. A copy media registration module as claimed in claim 1 wherein said drive roll system further comprises:

a) a plurality of counter rotating rolls defining a nip, for receiving the copy media from a feed path and advancing it to a target;

c) a detection system which detects misalignment of the copy media as it enters said nip; and d) an alignment correction device which properly aligns the copy media and advances it to said target.

3. A copy media registration module as claimed in claim 2 wherein said detection system further comprises sensors for detecting the translational, longitudinal and skew positioning of copy media in said feed path.

4. A copy media registration module as claimed in claim 3 wherein said alignment correction device responds to detection of longitudinal mis-positioning of copy media in said feed path by changing a drive speed of said counter rotating rolls.

5. A copy media registration module as claimed in claim 3 wherein said alignment correction device responds to detection of skew mispositioning of copy media in said feed path by changing a relative speed of said rolls.

6. A copy media registration module as claimed in claim 3 wherein said generator moves at least one roll at a variable rate of speed.

7. A copy media registration module as claimed in claim 3 wherein said generator moves at least one roll at a substantially constant speed.

8. A copy media registration module as claimed in claim 7 wherein said generator moves at least a second roll at a variable rate of speed.

9. A copy media registration module as claimed in claim 3 wherein said alignment correction device responds to detection of translational mis-positioning of copy media in said feed path by moving said rolls transversely with respect to said feed path.

10. A copy media registration module as claimed in claim 3 wherein said sensors are optical sensors.

11. A copy media registration module as claimed in claim 1 wherein said generator is electronically controlled.

12. A copy media registration module as claimed in claim 11 wherein said generator is a two phase, brushless, direct current motor.

13. A copy media registration module as claimed in claim 11 wherein said drive roll system includes an adaptive electronic registration system for continuously providing feedback from said alignment correction device, said adaptive electronic registration system further comprising:

a) a tracking device which obtains a motion profile for individual copy media as they enter said nip, undergo alignment correction, and are placed upon said target;

b) a storage device which retains said motion profiles for a plurality of said individual copy media; and c) a feedback device communicating with said electronically controlled generator to vary a motion imposed upon said drive roll system based upon an actual motion of prior copy media.

14. A copy media registration module as claimed in claim 1 further comprising an adaptive sensor which distinguishes between transparent and opaque copy media as said copy media enters said drive roll system, said adaptive sensor further comprising:

a) a light source;

b) a light sensing device in a receiving relationship with said light source for generating signals indicative of sensed light intensity; and c) a control electrically connected to said light source and said light sensing device to adjust and maintain signals indicative of sensed light intensity.

15. A copy media registration module as claimed in claim 14 wherein said adaptive sensor tilted at an angle with respect to the horizontal of the copy media.

16. A copy media registration module as claimed in claim 14 wherein said light source is an LED disposed near said feed path for projecting light toward said feed path.

17. A copy media registration module as claimed in claim 14 wherein said light sensing device is a phototransistor located relative to said light source to receive light reflected from copy media within said feed path and provide an output signal proportional to an amount of light received from the copy media.

18. A copy media registration module as claimed in claim 1 further comprising means for controlling wear of an image fusing system.

19. A copy media registration module as claimed in claim 18 wherein said image fusing system wear control means further comprises:

a) counting a number of sheets of the copy media that have passed through a fusing system; and b) incrementally shifting a location of placement of the copy media in a direction transverse to a copy path once a designated number of copy media sheets have passed through said fusing system.

20. A copy media registration module as claimed in claim 1 further comprising an apparatus for detecting a presence of pre-existing holes in the copy media.

21. A copy media registration module as claimed in claim 20 wherein said pre-existing hole detection means further comprises:

a) a copy media transport for moving the copy media along a path;

b) a registration system for placing the copy media at a designated location at an end of said path;

c) a microprocessor, communicating with said registration system to adjust a location at which the copy media is placed at said path end;

d) a light source, situated along said path;

e) a light sensing device in a receiving relationship with said light source for sensing a light intensity from said light source, and generating signals indicative of said sensed light intensity, said sensed light intensity including a first signal when no light is sensed and a second signal when light is sensed;

f) a detecting device for receiving said generated signals from said light sensing device, and for transmitting signals to a timing device at points at which generated signals transition between said first signal and said second signal;

g) a timing device which counts an amount of time that elapses after a transition has taken place, and transmits a timing signal to said microprocessor when a designated time period has elapsed.

22. An electrophotographic printing machine, comprising:

a) an electrophotographic imaging member upon which an electrostatic latent image is generated, and onto which a developer material is deposited to transform said latent image into a developed image;

b) a paper tray for storing copy media, and for advancing said copy media to a feed path, said copy media being transported from said paper tray and through the electrophotographic printing machine along said feed path; and c) a copy media registration module removable from and replaceable to a location in the printing machine between an end of said feed path and said electrophotographic imaging member as a single unit, said copy media registration module advancing said copy media to said electrophotographic imaging member, and detecting and eliminating a misalignment of said copy media, as said copy media is advanced to said electrophotographic imaging member.

23. An electrophotographic printing machine as claimed in claim 22 wherein said copy media registration module further comprises:

a) a drive roll system;

b) a generator which imposes motion upon said drive roll system;

c) a connector for attaching said generator to an external power supply; and d) a housing encompassing said drive roll system and said generator such that said housing, said drive roll system and said generator are mountable to and removable from an external device as a single unit.

24. An electrophotographic printing machine as claimed in claim 23 wherein said drive roll system further comprises:

a) a plurality of counter rotating rolls defining a nip, for receiving the copy media from said a path and advancing it to a target;

b) a detection system which detects misalignment of the copy media as it enters said nip; and c) an alignment correction device which properly aligns the copy media and advances it to said target.

25. An electrophotographic printing machine as claimed in claim 24 wherein said detection system further comprises sensors for detecting the translational, longitudinal and skew positioning of copy media in said feed path.

26. An electrophotographic printing machine as claimed in claim 25 wherein said sensors are optical sensors.

27. An electrophotographic printing machine as claimed in claim 23 wherein said generator is electronically controlled.

28. An electrophotographic printing machine as claimed in claim 27 wherein said generator is a two phase, brushless, direct current motor.

29. An electrophotographic printing machine as claimed in claim 27 wherein said drive roll system includes an adaptive electronic registration system, further comprising:

a) a tracking device which obtains a motion profile for individual copy media as they enter said nip, and advance to said target in proper alignment;

b) a storage device which retains said motion profiles for a plurality of said individual copy media; and c) a feedback device communicating with said electronically controlled generator to vary a motion imposed upon said drive roll system based upon an actual motion of prior copy media.

* * * * *